US010662031B2

(12) United States Patent
Villa

(10) Patent No.: US 10,662,031 B2
(45) Date of Patent: May 26, 2020

(54) ELEVATOR CAR ROLLER GUIDE AND METHOD OF USE

(71) Applicant: Inventio AG, Hergiswil (CH)

(72) Inventor: Valerio Villa, Colverde (IT)

(73) Assignee: INVENTIO AG, Hergiswil NW (CH)

( * ) Notice: Subject to any disclaimer, the term of this patent is extended or adjusted under 35 U.S.C. 154(b) by 341 days.

(21) Appl. No.: 15/535,745

(22) PCT Filed: Dec. 14, 2015

(86) PCT No.: PCT/EP2015/079545

§ 371 (c)(1),
(2) Date: Jun. 14, 2017

(87) PCT Pub. No.: WO2016/096692

PCT Pub. Date: Jun. 23, 2016

(65) Prior Publication Data

US 2017/0349408 A1 Dec. 7, 2017

(30) Foreign Application Priority Data

Dec. 17, 2014 (EP) ..... 14198492

(51) Int. Cl.
*B66B 1/34* (2006.01)
*B66B 7/04* (2006.01)
*B66B 11/02* (2006.01)

(52) U.S. Cl.
CPC ..... *B66B 7/042* (2013.01); *B66B 7/044* (2013.01); *B66B 11/028* (2013.01)

(58) Field of Classification Search
CPC ..... B66B 7/042; B66B 7/044; B66B 11/028
USPC ..... 187/247, 282, 292, 391, 393; 188/155–165, 266.2, 267, 267.2, 290
See application file for complete search history.

(56) References Cited

U.S. PATENT DOCUMENTS 5,573,088 A * 11/1996 Daniels ..... B60G 17/0157 188/267
6,854,573 B2 * 2/2005 Jolly ..... F16D 57/002 188/161
7,051,849 B2 * 5/2006 Browne ..... F16F 9/535 188/266.4
7,543,686 B2 * 6/2009 Kulak ..... B66B 7/044 187/292
7,896,358 B2 * 3/2011 Hoff ..... B66F 17/003 180/282
8,631,917 B2 * 1/2014 Piech ..... B66B 1/32 188/161
8,761,947 B2 * 6/2014 Wang ..... F16F 9/535 187/228
8,768,522 B2 * 7/2014 Wang ..... B66B 7/042 187/282

(Continued)

FOREIGN PATENT DOCUMENTS

JP H01299181 A 12/1989

*Primary Examiner* — Anthony J Salata
(74) *Attorney, Agent, or Firm* — William J. Clemens; Shumaker, Loop & Kendrick, LLP

(57) ABSTRACT

A roller guide for an elevator car includes at least one roller rotatably mounted on an axis. The roller guide further includes a support element for supporting the axis, and at least one braking element for the roller for damping vertical oscillations of the elevator car. The brake element is a magneto-rheological fluid.

15 Claims, 3 Drawing Sheets

(56) References Cited

U.S. PATENT DOCUMENTS

| | | | | |
|---|---|---|---|---|
| 8,849,465 | B2 * | 9/2014 | Wang | B66B 7/042<br>187/282 |
| 2006/0243538 | A1 | 11/2006 | Husmann | |
| 2009/0308696 | A1 | 12/2009 | Utsunomiya | |

* cited by examiner

ELEVATOR CAR ROLLER GUIDE AND METHOD OF USE

FIELD

The invention relates to a roller guide for an elevator car, an elevator car, an elevator system and a method for damping vertical vibrations during operation of an elevator car.

BACKGROUND

Elevator cars are frequently guided along a guide rail with one or more so-called roller guide shoes in an elevator shaft. The car is usually suspended on a supporting means, in particular one or more belts or cables. The supporting means are in this case coupled to a drive machine which is usually disposed at the upper end of the elevator shaft. As a result of the elasticity of the supporting means and in the case of a large height difference between drive machine and elevator car, the elevator car executes undesirable vertical oscillations, in particular during entry and exit of passengers. However these oscillations can only be eliminated with difficulty.

One possibility for reducing these oscillations can be found in JP 01299181 A. This document describes a blocking element which attenuates these vertical oscillations. For this purpose the blocking element is arranged on a roller guide of the elevator car and consists of a piezo-electronic material. During travel this blocking element has a distance from the elevator car so that no blocking takes place. When the car stops, an electrical signal causes a volume expansion of the piezoelectric material so that the blocking element presses onto a roller of the roller guide and blocks this. The friction between roller and guide rail thus impedes the upward and downward oscillation of the elevator car.

However, such a blocking element has the disadvantage that the blocking process is associated with very loud noises. Many individual components are required and manufacture is associated with high costs. In addition, wear effects can rapidly occur, which involves a high maintenance expenditure.

SUMMARY

It is therefore an object of the invention to provide a roller guide for an elevator car which damps the vertical oscillations without producing significant auxiliary noise, which is simple to manufacture and which additionally has a long lifetime. It is also an object of the invention to provide a method for damping vertical oscillations during operation of an elevator car.

The invention relates to a roller guide for an elevator car. The roller guide comprises at least one rotatably mounted roller which is arranged on an axis as well as a support element for supporting the axis. The roller guide further comprises at least one brake element for the roller for damping preferably vertical oscillations of the elevator car, in particular during entry and exit of passengers. The brake element comprises a magneto-rheological fluid, which magneto-rheological fluid enables a braking of the rotary movement of the roller.

Magneto-rheological fluids are suspensions of magnetically polarizable particles, for example, iron particles which are finely distributed in a carrier liquid. When a magnetic field is applied, the particles are polarized, are directed along the field lines of the magnetic field and form chains. This results in a change in the viscosity of the magneto-rheological fluid. This change can take place in a few milliseconds and is reversible It is possible to vary the viscosity of the fluid as far as a solid state by means of the intensity of the magnetic field. A rotary movement of the roller can be monitored and controlled by means of the magnitude of the viscosity of the magneto-rheological fluid of the brake element.

Such a device has the advantage that when the elevator car stops at the floor, the rotary movement of the roller is braked more efficiently and vertical oscillations are damped more efficiently by the brake element. At the same time, the braking and damping of the vertical oscillations is very low-noise. The entry and exit of the passengers is perceived as more pleasant. Magneto-rheological components are low-maintenance which additionally increases the lifetime of the roller guide.

Preferably a relative movement between the roller and the support element can be braked by activating the magneto-rheological fluid, where the roller typically rotates about an axis of rotation relative to the support element. The rotary movement of the roller mounted on the axis can be influenced, preferably can be braked, by activating the magneto-rheological fluid. This relative movement can be completely or partially braked, wherein "completely" means a stoppage of the relative movement and "partially" means a slowing of the relative movement.

"Activating" is understood as a change in the viscosity of the magneto-rheological fluid by generation of a magnetic field. The magnetic field can, for example, be produced by means of a current signal which flows through an electrical conductor, for example, a wire. Such an electrical conductor can easily be integrated in the brake element. Since the magneto-rheological fluid has a known viscosity in particular during travel of the elevator car but also during stoppage at a floor, the roller guide can also be used for detecting vertical accelerations.

The shape and alignment of the magnets generating this magnetic field or the corresponding coil as well as the adjustment of the magnetic field intensity enable a specific influencing of the magneto-rheological fluid. The electrically controllable magnetic field can, for example, be implemented by means of this coil.

This has the advantage that no additional holders are required for the brake element. A simple force flow is made possible. The braking can be controlled exactly and wear effects are minimized due to reversibility of the state of the magneto-rheological fluid.

In a further development of the roller guide, the viscosity of the magneto-rheological fluid is variable during travel of the elevator car in order to influence the acceleration of the elevator car, preferably the vertical acceleration of the elevator car.

The brake element can be at least two-part, wherein a primary part is in operative communication with the roller and a secondary part is in operative communication with the support element. The primary part can be configured in such a manner that it is fixedly mounted on the roller. The secondary part can be fixedly mounted on the support element. However, it is also feasible that the primary part is mounted on the support element and the secondary part is mounted on the roller. In this case, "fixedly" can mean that the parts are interconnected by means of a force fit or tight fit, wherein fixed and also detachable connections are conceivable, for example, by screwing, adhesive bonding, welding or clamping.

Such a brake element is characterized in that an exact control of the force transmission to the relative movement between the roller and the support element is made and thus a rapid braking and damping effect is achieved.

Preferably the primary part and the secondary part of the brake element form a closed cavity filled with the magneto-rheological fluid. The primary and the secondary part can be in direct contact with the magneto-rheological fluid. The primary and the secondary part can have surface-enlarging contours, for example, lamellae which are in contact with the fluid and are movable therein. It is feasible that the lamellae are arranged over the entire primary and/or secondary part or only in sections with a break.

The advantage consists in that the brake element is prefabricated as a complete component. No additional individual parts are required.

The magneto-rheological fluid in a non-activated state and in particular during a travel of the elevator car can have a lower viscosity than in an activated state and in particular during a stoppage of the elevator car. Lower viscosity of the fluid accordingly means that the fluid is thinner. A "non-activated state" in this case means a low viscosity as a result of the absence of the magnetic field whereas "activated state" is understood as a high viscosity which comes about as a result of the magnetic field. The magnetic field can be produced, for example, by means of an electrical conductor through which an electrical signal flows.

This allows an easy-running, wear-free movement of the roller of the roller guide during travel of the elevator car. When the car stops on the other hand, the roller can only be rotated with difficulty and a high friction resistance is produced which leads to damping of the vertical oscillations. The braking effect on the rollers can additionally be adjusted exactly by means of the viscosity of the magneto-rheological fluid.

The state of the magneto-rheological fluid can be controlled by means of a state control element of an elevator control and in particular this state control element can be coupled to a status signal of the elevator car door. The state control element can for example, be a software program or a physical switch and be arranged on the elevator car door. The state control element can be coupled to an electrical conductor which can transmit the opening and closing of the elevator car door as status signal to the brake element. The electrical conductor can be arranged in the form of a coil around or in the brake element. As a result of a resulting current flow, a magnetic field can be generated in the brake element. The intensity of the magnetic field can then control the magnitude of the viscosity of the magneto-rheological fluid.

The control of the state of the magneto-rheological fluid by means of the elevator control has the advantage that a rotatability of the rollers of the roller guide can be adjusted by means of the state of the magneto-rheological fluid and can be adapted to the operation of the elevator.

The roller can be rotatably mounted on the axis. The roller can, for example, be rotatably mounted on the axis by means of a ball bearing. The axis can be connected to the support element in a torque-proof manner. However, it is also possible to arrange the roller in a torque-proof manner on the axis and mount the axis rotatably in the support element. "In a torque-proof manner" is understood to mean that the torque-proof components are not rotatable relative to one another in relation to a common axis of rotation.

Such a roller guide is characterized by a simple assembly, in particular of the roller. No additional individual parts are required.

The brake element can be arranged inside the roller on the axis. The roller can have a recess in which the brake element is integrated. The brake element can be connected in this case via the primary part to the axis and the secondary part can be connected to the roller. The reverse variant is also feasible. It is also feasible that the brake element is arranged around the axis in the form of a clip. Alternatively the axis can be completely enclosed by the brake element in cross-section. It is further conceivable that the brake element is arranged between the roller and the support element or only on the support element.

Such a device is characterized by a lower expenditure of material and space requirement. The manufacturing costs are reduced.

Alternatively, the axis can be mounted rotatably in the support element. A rotatable mounting can be accomplished, for example, by means of a ball bearing. The axis can be connected in a torque-proof manner, for example, by means of a force fit, to the roller. However, it is also feasible that the axis and the support element are connected to one another in a torque-proof manner and the roller is mounted rotatably on the axis. A torque-proof connection of the roller and the axis or the axis and the support element can be accomplished for example by means of a force fit.

The advantage of this device lies in the easy assembly of the roller guide without additional individual parts.

A further aspect of the invention relates to an elevator car with a roller guide. The roller guide, preferably as described in the present case, comprises a brake element which comprises a magneto-rheological fluid. The brake element can be connected to an elevator control via a state control element. In particular, the state control element can be coupled to a status signal of the elevator car door. Thus, for example a signal transmission to the brake element can take place as soon as the elevator car doors open or close. This signal transmission can take place, for example via an electrical conductor to the brake element. This electrical signal can activate and regulate the magneto-rheological fluid in the brake element. For example, shortly before the elevator car stops, an electrical signal is triggered in the state control element and fed to the brake element. A magnetic field is generated and the viscosity of the magneto-rheological fluid is increased. The roller of the roller guide is braked and thus the elevator car also. At the same time, the vertical oscillations can be damped.

Such an elevator car with a roller guide is characterized by the fact that in particular vertical oscillations can be more effectively damped and in addition, a low-noise damping is possible. The damping of the vertical oscillations, in particular during entry and exit of passengers, allows a better feeling of wellbeing among the passengers. As a result of the double function of the brake element, braking and damping, fewer components are required during manufacture of the elevator car and the costs are reduced. In addition, manufacture is simpler and faster, with the result that delivery times for such an elevator car are reduced. Such an elevator car can easily be installed in a corresponding elevator shaft by simple coupling.

A further aspect of the invention relates to an elevator system with an elevator car as described in the present case.

Such an elevator system has the advantage that it is low-noise, and wear effects are minimized. The maintenance expenditure and the maintenance costs are low. In addition, the individual components can be better matched to one another.

A further aspect of the invention relates to a method for damping preferably vertical oscillations during operation of an elevator car. The elevator car in this case has a roller guide comprising at least one rotatably mounted roller. The damping of vertical oscillations takes place in particular during a stoppage of the elevator car and/or during entry and exit of passengers, wherein the rotary movement of the roller is braked with a brake element which comprises a magneto-rheological fluid.

The method is characterized by a low-noise damping of the vertical oscillations and a low-noise braking. In addition, a low-wear operation of an elevator car is made possible, and maintenance costs are minimized.

Preferably the rotary movement of the roller is influenced, preferably braked, by activating the magneto-rheological fluid. The activation can be accomplished by producing a magnetic field, for example, by applying a current signal to an electrical conductor. This magnetic field causes a change in the viscosity of the magneto-rheological fluid within milliseconds from low to high. The roller can be completely or only partially braked, where a complete braking involves a stopping of the roller and therefore of the elevator car and a partial braking allows a slowing of the roller and therefore the elevator car.

A braking of the roller by means of the activation of the magneto-rheological fluid has the advantage that the rotary movement of the roller can be regulated. Wear effects are minimized.

Preferably a relative movement between the roller and a support element for the roller is braked.

This has the advantage that no additional mounting elements need to be attached for attachment of the brake element and therefore no additional components need be attached to the roller and/or support element.

A state of the magneto-rheological fluid can be activated by means of a state control element of an elevator control. Preferably the magneto-rheological fluid of the brake element is transferred into a state of higher viscosity during stoppage of the elevator car than during a travel of the elevator car.

The activation of the state of the magneto-rheological fluid via the elevator control has the advantage that the braking and damping properties can be adapted to the operation of the elevator and the rotary movement of the roller of the roller guide is adjustable via the state of the magneto-rheological fluid.

Mineral oil and/or a synthetic oil and/or ethylene glycol and/or water can be used as carrier fluid of the magneto-rheological fluid. In addition, an adjuvant or several adjuvants can be part of the magneto-rheological fluid. Such an adjuvant prevents sedimentation or agglomeration of the magnetically polarizable particles within the suspension. Adjuvants are for example stabilizers and/or viscosity improvers.

DESCRIPTION OF THE DRAWINGS

The invention will be explained in detail hereinafter with reference to figures which merely show exemplary embodiments. In the figures.

DETAILED DESCRIPTION

Figure 1:
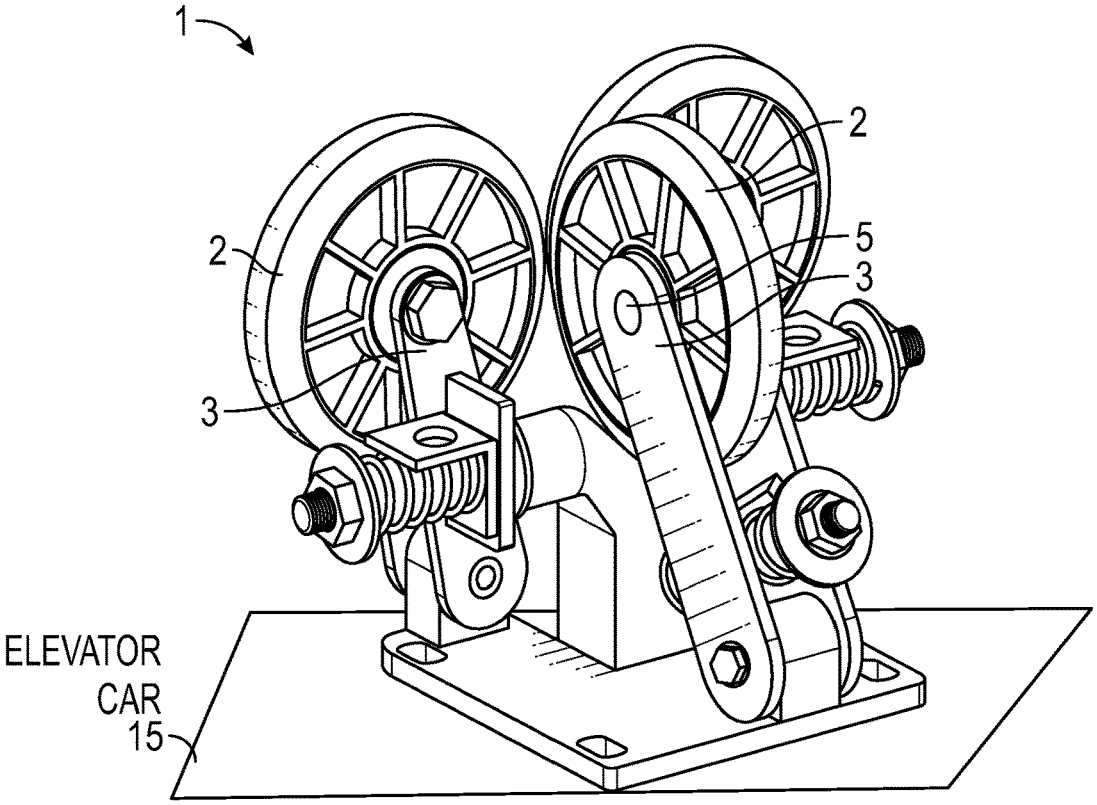
FIG. 1 (Prior Art)
FIG. 1: shows a roller guide from the prior art.

FIG. 1 shows a roller guide 1 as can be found on elevator cars in the prior art. The roller guide 1 comprises a roller 2, a support element 3 for an axis 5 and the axis 5. These roller guides 1 are usually mounted on the elevator cars and enable guidance of the elevator along a guide rail in the elevator shaft. The roller guide 1 is mounted on an elevator car 15 (only a portion of the car is shown) and the roller guides 1 according to the invention shown in FIGS. 2-5 are mounted in the same manner.

Figure 2:
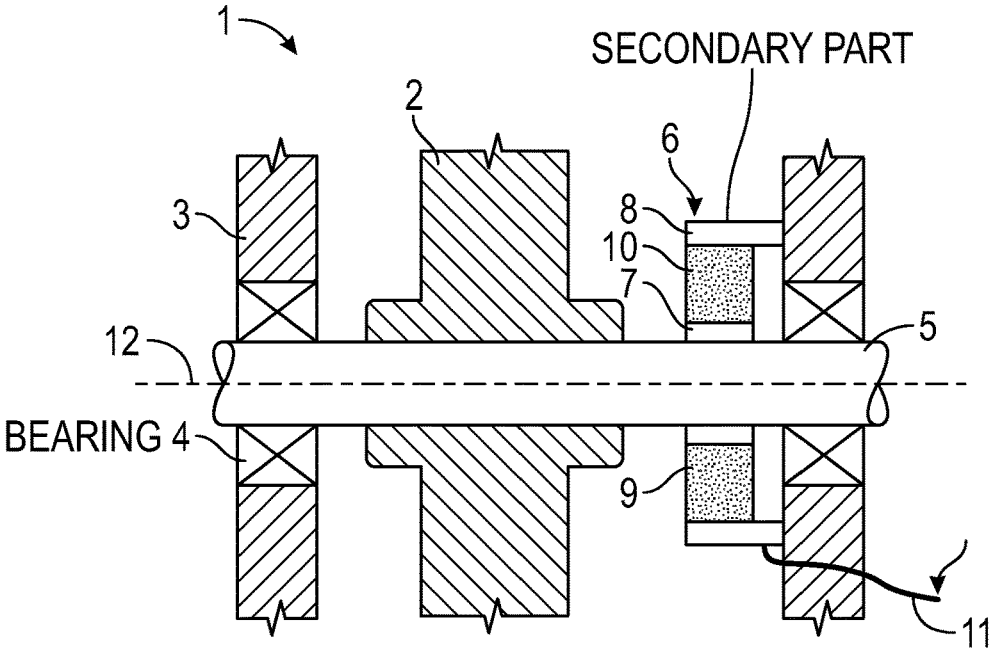
FIG. 2: shows a roller guide according to the invention in a sectional view.

FIG. 2 shows an exemplary embodiment of a roller guide 1 according to the invention in a sectional view along an axis of rotation 12 of a roller 2. The sectional view shows a roller 2 which is connected to the axis 5 in a torque-proof manner. The axis 5 is mounted rotatably with two bearings 4 in two support elements 3. Thus, the roller 2 and the axis 5 are rotatable relative to the support element 3. A brake element 6 is arranged on the axis 5 by means of which the relative movement between the roller 2 and the support element 3 can be braked. A primary part 7 of the brake element 6 is fixedly connected to the axis 5. A secondary part 8 of the brake element 6 is fixedly connected to one of the support elements 3. The primary part 7 and the secondary part 8 form a closed cavity 9 which is filled with a magneto-rheological fluid 10. The state of the magneto-rheological fluid 10 is controlled by means of an electric signal 11. During a travel of an elevator car the axis 5 with the roller 2 moves relative to the support element 3 about an axis of rotation 12 since the magneto-rheological fluid 10 has a lower viscosity. If a status signal 11 of the elevator car door reaches the brake element 6 and a magnetic field is generated by the current flow, the magneto-rheological fluid 10 is transferred to a higher viscosity and a rotary movement of the axis 5 with the roller 2 about the axis of rotation 12 is braked.

Figure 3:
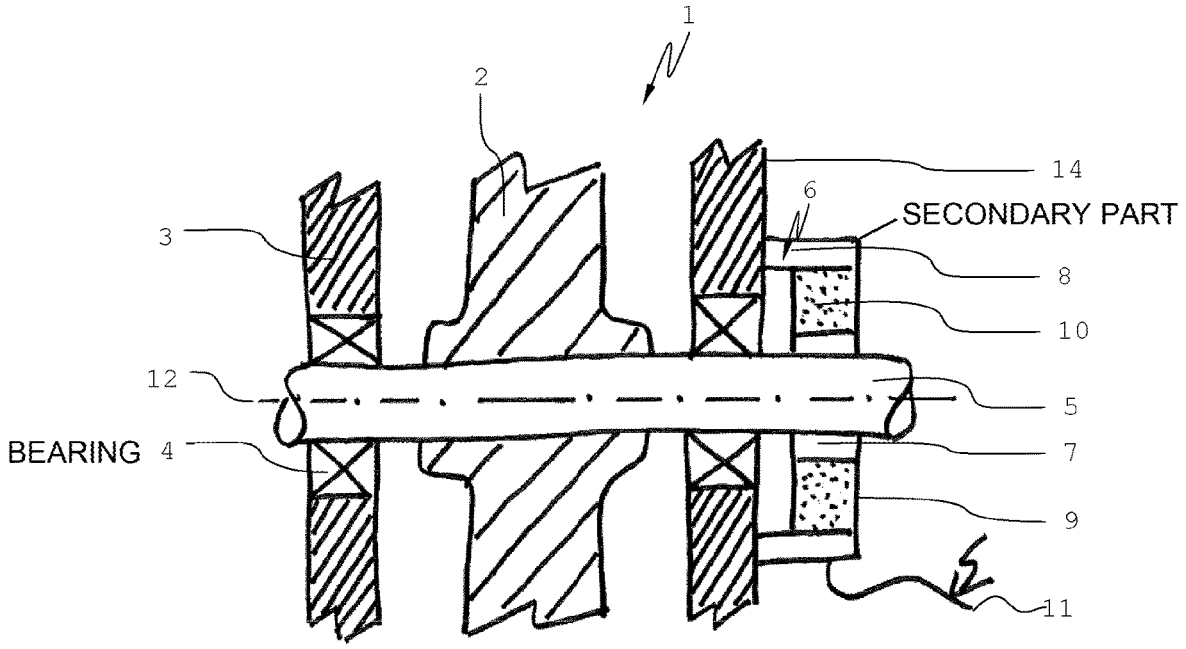
FIG. 3: shows another exemplary embodiment of a roller guide according to the invention in sectional view.

FIG. 3 shows another exemplary embodiment of the roller guide 1. The same reference numbers designate the same parts as in FIG. 2. In this embodiment the brake element 6 is arranged with its primary part 7 on the rotatably mounted axis 5 and the secondary part 8 is fixedly connected to the support element 3. However, the brake element is not arranged between the roller 2 and the support element 3 as in FIG. 2 but on an outer side 14 of the support element 3. This allows a compact design of the roller guide 1. The function and the effect further correspond to the exemplary embodiment from FIG. 2.

Figure 4:
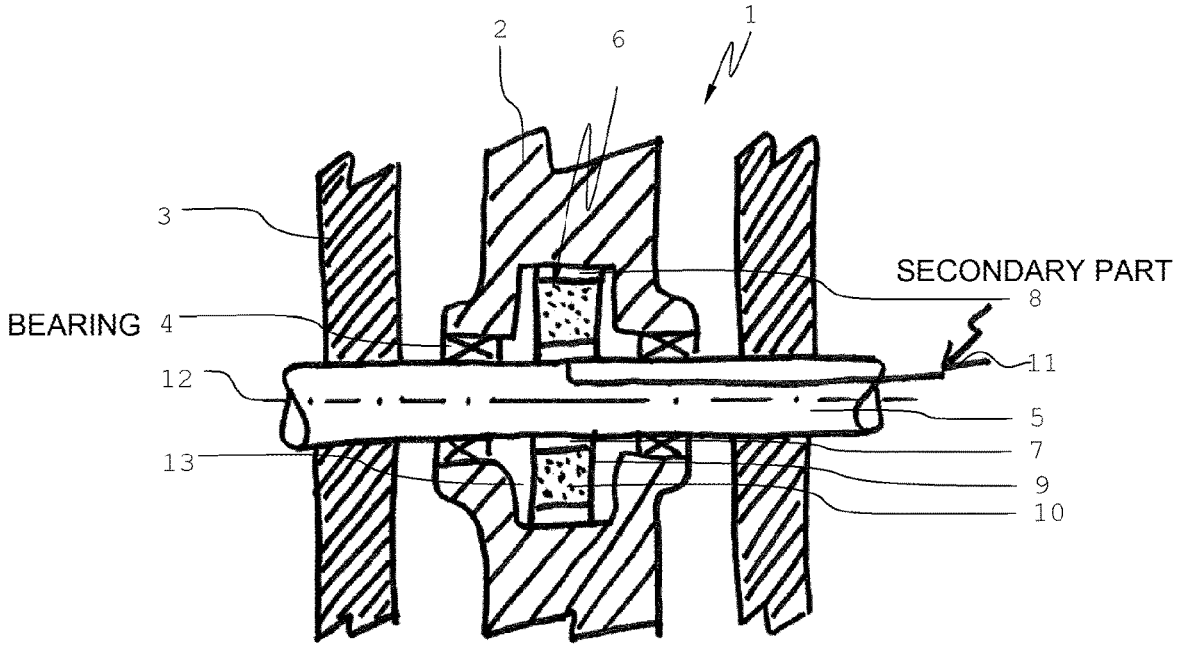
FIG. 4: shows another exemplary embodiment of a roller guide according to the invention in sectional view.

FIG. 4 shows another exemplary embodiment of the roller guide 1. In this embodiment the roller 2 is mounted rotatably about the axis 5 with the bearings 4. The axis 5 is connected to the support element 3 in a torque-proof manner. The brake element 6 is arranged inside a recess 13 of the roller 2. The primary part 7 of the brake element is fixedly connected to the axis 5 whereas the secondary part 8 is fixedly connected to the roller 2. The primary part 7 and the secondary part 8 form a closed cavity 9 in which the magneto-rheological fluid 10 is located. The viscosity of the magneto-rheological fluid can be varied by means of the status signal 11, as already described for FIG. 2.

Figure 5:
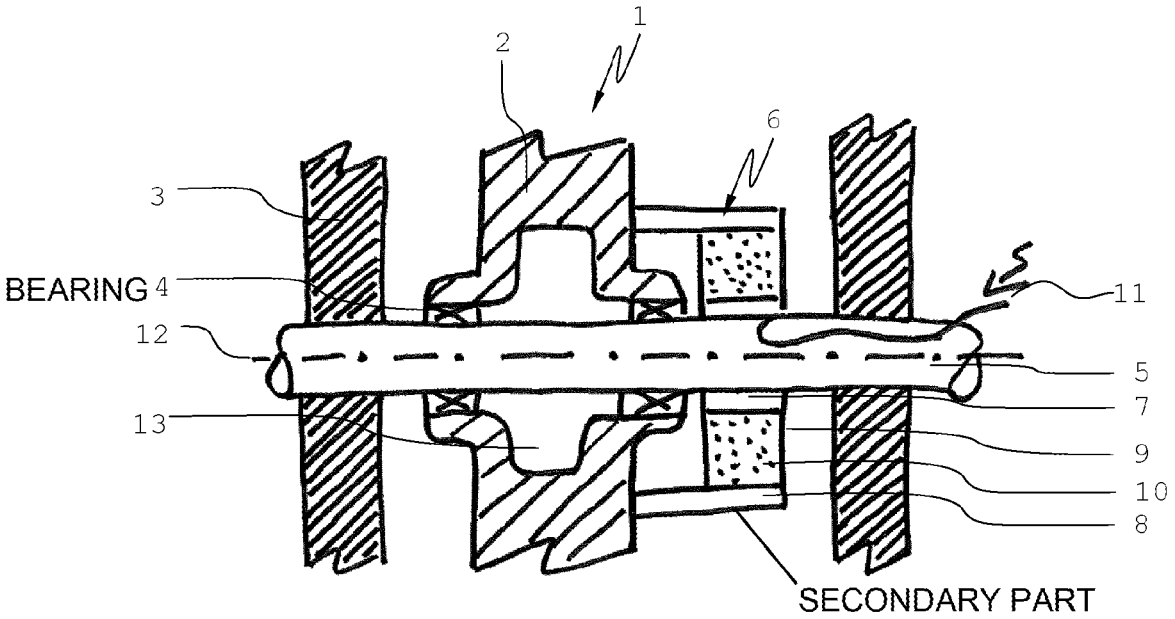
FIG. 5: shows another exemplary embodiment of a roller guide according to the invention in sectional view.

FIG. 5 shows another exemplary embodiment of a roller guide 1. The same reference numbers designate the same components as in FIG. 4. In this exemplary embodiment the brake element 6 is arranged between the roller 2 and the support element 3 as in FIG. 2 whereas in contrast to the exemplary embodiment from FIG. 2, the relative movement between the roller 2 and the axis 5 can be braked. The primary part 7 is connected to the axis and the secondary part 8 is connected to the roller. The function and the effect are described for the exemplary embodiment from FIG. 2.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A roller guide for mounting on an elevator car and for damping vertical oscillations of the elevator car during stopping of the elevator car, comprising:

a rotatably mounted roller arranged at an axis;

a support element supporting the axis; and a brake element acting on the roller and including a magneto-rheological fluid for braking a rotary movement of the roller.

2. The roller guide according to claim 1 wherein the rotary movement of the roller is braked by activating the magneto-rheological fluid.

3. The roller guide according to claim 2 wherein the magneto-rheological fluid is activated by an electrically controllable magnetic field generated by a coil.

4. The roller guide according to claim 1 wherein the brake element has a primary part in operative communication with the roller and a secondary part in operative communication with the support element.

5. The roller guide according to claim 4 wherein the primary part and the secondary part of the brake element form a closed cavity filled with the magneto-rheological fluid.

6. The roller guide according to claim 1 wherein the magneto-rheological fluid in a non-activated state has a lower viscosity than in an activated state.

7. The roller guide according to claim 6 wherein a state of the magneto-rheological fluid is controlled by an elevator car door status signal.

8. The roller guide according to claim 1 wherein the roller is rotatably mounted on the axis.

9. The roller guide according to claim 8 wherein the brake element is arranged inside the roller on the axis.

10. The roller guide according to claim 1 wherein the axis is mounted rotatably in the support element.

11. An elevator car having mounted thereon at least one of the roller guide according to claim 1.

12. A method for damping vertical oscillations during operation of an elevator car having a roller guide with at least one rotatably mounted roller, comprising the steps of:

providing a brake element having a magneto-rheological fluid; and braking rotary movement of the at least one roller using the brake element.

13. The method according to claim 12 wherein the rotary movement of the at least one roller is braked by activating the magneto-rheological fluid.

14. The method according to claim 13 wherein a relative movement between the at least one roller and a support element for the at least one roller is braked.

15. The method according to claim 13 including activating a state of the magneto-rheological fluid with an elevator car door status signal and wherein the magneto-rheological fluid is transferred into a state of higher viscosity in response to the status signal.

* * * * *